US008052841B2

(12) United States Patent
Ahlgren et al.

(10) Patent No.: US 8,052,841 B2
(45) Date of Patent: Nov. 8, 2011

(54) PROCESS FOR MANUFACTURING OF PAPER

(75) Inventors: Jonni Ahlgren, Vaasa (FI); Kimmo Strengell, Vaasa (FI)

(73) Assignee: Kemira Oyj, Helsinki (FI)

( * ) Notice: Subject to any disclaimer, the term of this patent is extended or adjusted under 35 U.S.C. 154(b) by 239 days.

(21) Appl. No.: 10/553,358

(22) PCT Filed: Apr. 14, 2004

(86) PCT No.: PCT/FI2004/000229

§ 371 (c)(1),
(2), (4) Date: Mar. 21, 2007

(87) PCT Pub. No.: WO2004/092482

PCT Pub. Date: Oct. 28, 2004

(65) Prior Publication Data

US 2008/0035293 A1 Feb. 14, 2008

(30) Foreign Application Priority Data

Apr. 15, 2003 (FI) ..... 20030568

(51) Int. Cl.
*D21H 19/00* (2006.01)

(52) U.S. Cl. ..... 162/181.7
(58) Field of Classification Search ..... 162/181.7
See application file for complete search history.

(56) References Cited

U.S. PATENT DOCUMENTS

| | | | | | |
|---|---|---|---|---|---|
| 2,992,964 | A * | 7/1961 | Werner et al. | 162/178 |
| 3,758,376 | A * | 9/1973 | Beckner | 162/162 |
| 4,461,810 | A | 7/1984 | Jacobson | |
| 5,551,975 | A * | 9/1996 | Freeman et al. | 106/485 |
| 5,755,930 | A * | 5/1998 | Satterfield et al. | 162/164.1 |
| 6,143,064 | A * | 11/2000 | Virtanen | 106/449 |
| 6,743,286 | B2 * | 6/2004 | Wen et al. | 106/436 |
| 6,887,351 | B1 * | 5/2005 | Lunden et al. | 162/181.2 |
| 2001/0030032 | A1 * | 10/2001 | Keiser et al. | 162/181.6 |
| 2003/0024437 | A1 * | 2/2003 | Wen et al. | 106/436 |
| 2003/0066617 | A1 * | 4/2003 | Greenwood et al. | 162/158 |
| 2005/0150621 | A1 * | 7/2005 | Neivandt et al. | 162/175 |

FOREIGN PATENT DOCUMENTS

| | | | |
|---|---|---|---|
| CA | 2 316 281 | A1 | 7/1999 |
| CN | 1284103 | A | 2/2001 |
| FR | 2773167 | A1 | 7/1999 |
| FR | 2773180 | A1 | 7/1999 |
| WO | WO-97/18268 | A1 | 5/1997 |
| WO | WO 99/35193 | A1 * | 7/1999 |
| WO | WO-02/079572 | A1 | 10/2002 |

* cited by examiner

*Primary Examiner* — Matthew Daniels
*Assistant Examiner* — Jacob Thomas Minskey
(74) *Attorney, Agent, or Firm* — Birch, Stewart, Kolasch & Birch, LLC

(57) ABSTRACT

The invention relates to a process for manufacturing paper, in which a filler is pretreated and suspended to form an aqueous slurry, the aqueous slurry obtained is combined with an aqueous suspension containing cellulose fibers to form a stock, the stock obtained is treated at least with a cationic retention agent and the treated stock is filtered to form paper. Retention and optical properties are improved by the filler being pretreated with inorganic colloidal particles having an average size less than 100 nm.

36 Claims, No Drawings

PROCESS FOR MANUFACTURING OF PAPER

The invention relates to a process for manufacturing of paper, in which a filler is pretreated and suspended as water slurry, the water slurry obtained is combined with an aqueous suspension containing cellulose fibres in order to form a stock, the stock obtained is treated at least with a cationic retention agent and the treated stock is filtered and dried to form paper. The invention also relates to the use of inorganic colloidal particles in paper production.

Cellulose-based fibres and frequently also a particulate filler are used as raw materials in paper production. The filler replaces more costly fibres and usually enhances the optical properties of the paper.

The use of a filler involves the problem of poor retention to the paper web formed. Filler particles have an average diameter of typically less than 0.1 mm, whereas cellulose-based fibres have a typical size of more than 1 mm. Filler particles will thus pass through the wire in a papermaking machine, whose apertures typically have a diameter of the order of 0.2 mm, and thus the particles will have poor retention. Poor retention, again, tends to cause fouling of the machine, and is also otherwise uneconomic, because the same material will have to be pumped through the system several times.

Various retention agents have been developed for enhanced retention. Such agents comprise e.g. aluminium compounds, such as aluminium sulphate and polyaluminium chloride, cationic starch, cationic short-chained polyelectrolytes, such as polydiallyldimethyl ammonium chloride (polyDADMAC), long-chained polyelectrolytes such as cationically and anionically charged polyacrylamides and so called anionic colloidal systems such as bentonite and silica sols. Among these, polyacrylamides have the most effective retention action.

These anionic colloids are typically used together with a cationic retention polymer, such as polyacrylamide and/or a cationic starch. These systems have the typical feature of initial addition of a polymer to the stock containing filler particles and cellulose fibres, the polymer flocculating the finely divided substance contained in the stock, including the filler. As the stock proceeds towards the wire, it is subjected to shearing forces, which decompose the floccules. This results in decomposed floccules, having on their surface the cationic surface charge generated by the retention polymer. Subsequently, when an anionically charged colloid is added to the stock, it will gather the decomposed floccules together, thus improving both the retention of fines and dewatering of the web.

Such known systems based on a cationic polymer and an anionic colloid comprise the Hydrocol system of Ciba, cf. i.a. U.S. Pat. Nos. 4,753,710, 4,913,775, EP 707673 and U.S. Pat. No. 6,063,240, in which the anionic colloid is typically bentonite, and the Compozil system of Akzo Nobel, in which the anionic colloid is typically a colloidal silica sol. In some systems, such as the Organosorb systems, cf. e.g. EP 17353 and U.S. Pat. No. 4,305,871, the anionic colloid is added to the stock before the cationic retention polymer.

However, in this application alone, anionic colloids have the drawback of hard floccules tending to form around them, these floccules resulting in sharp visually detectable spots on the paper. Also, in this application, anionic colloids do not function properly in all paper manufacturing processes.

Fillers typically not only replace more costly cellulose fibres but also enhance the optical properties of paper. However, there are also more expensive filler with excellent optical properties in use. Titanium oxide $TiO_2$ is a good example of such a filler. It has a very small average particle diameter, of the order of 200 nm alone, so that it has particularly problematic retention. Since it is also an efficient and expensive material, there have been successful efforts to minimise its consumption. To ensure titanium dioxide retention, efficient retention systems have to be used. However, this involves the risk of too efficient flocculation of titanium dioxide particles, so that they are not evenly distributed in the paper and they will have a less effective impact on the optical properties of the paper. This, again, requires increased doses.

It is previously known to subject a filler to pre-treatment with different substances to achieve enhanced retention efficiency. Usual methods have comprised treatment of the filler with an organic cationic polymer, either a short-chained high cationic polymer or a long-chained retention polymer. Wilengowski et al. discuss in their article Zellst.Pap. (Leipzig) (1987), 36 (1), 21-4, the treatment of kaolin with polyDADMAC. Also Gill used cationic polymers for filler pre-treatment in his patent EP 445953, and so did Tajiri and Araki in their patent JP 08041798. Kim and Jo reported the use of retention polymers for filler pre-treatment in their article Palpu, Chongi Gisul (1993), 25(2), 31-31.

It is also known that cationic starch has been used for filler pre-treatment, i.a. Stepankova and Moravova depict in their article Pap. Celul. (1988), 43(6), 123-6 pre-treatment of kaolin with cationic starch and the improving effect of the pre-treatment on filler retention.

It is also known that other cationic filler pre-treatment agents have been used for improved filler retention: Tang and Chen described in their article Wujiyan Gongye (2000), 32(5), 26-27 pre-treatment of ground carbonate with a cationic surface modifying agent. Tomney et al. described in their article Pulp Pap. Can. (1998), 99(8), 66-69, filler pre-treatment with a coagulant. Lauzon depicted in his patent EP 491346 filler pre-treatment with cationic polymer derivatives. Roick and Lloyd described in their article Appita J. (1994), 47(1), 55-8, how the retention of calcinated kaolin improved when it was pre-treated with an aminosilane compound. GB patent 1204511 comprises filler treatment by forming an aqueous suspension of the filler, which is stabilised e.g. with polysilicic acid salt.

These examples show that improved retention of an inorganic pigment has usually been sought by adding organic cationic or soluble compounds to the pigment.

It has now been found that the paper production method described above can improve filler retention by filler pretreatment with inorganic colloidal particles, whose average particle size in water is less than 100 nm. In prior art, filler retention is improved only by additions of polymeric, cationic or soluble compounds. Hence it is surprising that pre-treatment with an inorganic colloid improves retention.

Pre-treatment with an inorganic anionic colloid is particularly advantageous, because it yields special benefits.

Firstly, an anionic colloid covers the filler particles by anionic charge, so that they flocculate more readily during addition of a cationic retention agent, and reflocculate after any shearing force treatment. Retention improves and the consumption of cationic retention agent will decrease. Secondly, only filler particles that have an important function will be covered with an anionic colloid. Other less important fines will remain uncovered. In other words, a smaller amount of anionic colloid will be required for filler retention. Thirdly, a larger portion of filler particles will be covered with anionic colloid and retained. This yields filler savings.

When used in the ordinary way as a part of a retention system in the short cycle of a paper production process, anionic colloids are not useful in all paper production processes. Filler pre-treatment with an anionic colloid promotes the runnability of such a process as well. Since colloid particles are added already to the filler, their even distribution on the filler surfaces is also ascertained, thus facilitating even distribution of filler particles such as titanium dioxide over the paper. This appears as more efficient optical effect of pigments, among other things.

The invention consequently has a marked synergetic advantage over prior art.

The invention relates to a method for manufacturing paper, paper implying a flat product formed substantially of cellulose fibres and produced by removing water from fibrous sludge on the wire. In accordance with the invention, a filler is pre-treated, pre-treatment denoting pre-treatment of the filler before it is combined with an aqueous suspension containing cellulose fibres. A filler in this context stands for any solids added under the paper formulation and having an average particle size smaller than the average size of cellulose fibres. We refer to the work Kirk-Othmer, Encycl. Chem. Tech. 3. Ed. Vol. 16, pages 777 to 780. Preferred fillers are presented in the following.

The inorganic colloid of the invention consists of very small at least partly negatively charged particles, whose average diameter length is less than 100 nm. An anionic colloid implies particles having anionic groups on their surface. The groups may be e.g. counter-ions of dissolved metal cations. Typical anionic colloids used in this invention comprise colloidal silicate particles, such as synthetic silicates, silicates of Mg and Al type, colloidal silica, fumed silica, and polysilicate microgel, polysilicic acid microgel and aluminium-modified derivatives of these.

Synthetic silicates include e.g. fumed or alloyed silica, silica gel and synthetic metal silicates. The latter group includes e.g. the product group "Laponite", the members of which are primarily synthetic metal silicates based on magnesium metal. Silicates of Mg and Al type comprise i.a. expanding clay types. i.e. smectite, such as montmorillonite, sometimes also called bentonite, hectorite, vermiculite, baidelite, saponite and sauconite, and also alloy and derivative silicates based on these. Colloidal silica types include i.a. structurised or unstructurised silica sol. Structurised silica sols comprise i.a. "BMA" products of Akzo and unstructurised silica sols comprise i.a. "Vinsil" products of Kemira. Fumed silica is sold under the trade name "Aerosil" (Degussa), among other things. An anionic organic colloid is typically an anionic organic polymer, whose particles are a copolymer of a water-soluble monomer and a water-insoluble monomer or a cross-linked water-soluble polymer. Such a polymer forms a micro-emulsion with water.

In the most preferred embodiment, the anionic colloid is a colloidal metal silicate pertaining to synthetic silicates, whose predominant cation is magnesium. This colloid has yielded the best results. It is sold under the product name "Laponite" (Rockwood).

As mentioned above, the inorganic colloid to be used in the invention was determined as consisting of particles with an average diameter less than 100 nm. It is preferably in the range of 1 to 100 nm. The latter size also meets the commonly used definition of colloid. Cf. i.a. Römpps Chemie-Lexikon, VII Aufl., 3. Teil, s. 1821.

The average particle diameter of inorganic colloid is in the range of 1-80 nm, preferably 1-50 nm, and most advantageously in the range of 1-25 nm. The specific area, (BET), which naturally depends on the particle size, is preferably in the range of 30-1000 $m^2/g$, more advantageously in the range of 100-1,000 $m^2/g$.

In a preferred embodiment of the invention, the filler is pre-treated with inorganic colloid in an amount in the range of 50-10,000 g/t, preferably 500-5,000 g/t, calculated on the total amount of dry filler. The colloid can be introduced in the filler in any form, in dry state or as a slurry, provided that it is ensured to be efficiently mixed with the filler. Commonly available stirring and elutriating devices can be used. Dry colloid particles can be added either to the dry filler, elutriating the obtained mixture in water, or in a dry state or as a slurry to the previously prepared filler suspension. The filler surface is preferably formed at least partly of said colloid particles.

Pre-treatment can be performed either by pretreating the entire filler amount with colloid, or by pretreating only a portion of the filler amount meant for the stock with a colloid, whereas the second portion is preferably in the water suspension of cellulose. In the latter case, the weight part of colloid of the total weight of colloid and the pre-treated portion of the filler amount is in the range of 0.5-20 kg/t, preferably in the range of 1-10 kg/t.

However, colloid particles are preferably used as an aqueous slurry or a sol, which is added to the filler suspension as such. The concentration of such a colloid slurry or sol depends on the colloid type used and it is typically in the range of 0.5-30%, preferably 1-10%.

The invention comprises pre-treatment of the filler. Its general definition is given above. In a preferred embodiment of the invention, it is an inorganic particulate substance. Such an inorganic particulate substance can not only replace more expensive fibre substances but also improve the paper brightness, opacity, formation, smoothness and compatibility with the printing ink. The inorganic particulate substance is preferably selected from the group consisting of kaolin, calcinated kaolin, calcium carbonate, talcum, titanium dioxide, calcium sulphate and synthetic silicate and aluminium hydroxide fillers.

Kaolin is used both as a substitute filler and as a coating pigment. It is an inexpensive naturally occurring hydrated aluminium silicate. Calcium carbonate is especially used in book-printing and cigarette paper grades. It can be produced as a by-product in caustication at a pulp mill or it can be obtained as pulverised limestone or chalk.

Titanium dioxide $TiO_2$ is the optimal filler. Besides in this invention for improving retention, it is advantageous for improving the optical properties of paper, such as opacity. This is why it is frequently used in fine-grade papers. There are two forms of titanium dioxide used: anatase and rutile. Given the extremely high price of titanium oxide compared to other fillers, it is used in very small amounts compared to other fillers, and then it is even more important to achieve good retention and even distribution in the paper.

The preferred particle size of the filler used in the invention depends on the filler quality. Thus kaolin has a typical average particle diameter in the range of 500-1,000 nm, calcium carbonate in the range of 200-400 nm, talcum in the range of 1,000-10,000 nm, titanium dioxide in the range of 150-350 nm and synthetic silicate in the range of 100-400 nm. A preferred filler is titanium dioxide having an average particle diameter in the range of 150-250 nm, most advantageously approx. 200 nm.

The overall amount of filler used in the invention calculated on the dry weight of stock is typically 2-80%, more advantageously 10-60%, most advantageously 20-50%. When the filler in the method of the invention is suspended to form an aqueous slurry before or after the pre-treatment, the slurry typically has a concentration in the range of 10-70% and preferably 20-50%.

The aqueous slurry of the filler pre-treated in accordance with the invention is combined with an aqueous suspension of cellulose. This may be performed in any manner, but typically this aqueous slurry is mixed in the aqueous suspension of cellulose. The cellulose may derive from pulp produced by any process, such as chemical, mechanical or chemo-mechanical pulp, recycled fibres or a mixture of these. The consistency of the aqueous suspension of cellulose depends on the raw materials used and the paper production process adopted, being e.g. in the range of 1-50 g/l, typically in the range of 5-15 g/l.

Combining an aqueous slurry of pretreated filler with an aqueous suspension of cellulose aims at an aqueous stock having a given consistency, i.e. dry matter content. In one embodiment of the invention, the aqueous slurry is combined with an aqueous suspension of cellulose in order to form a stock having overall consistency in the range of 3-20 g/l, preferably 5-15 g/l, and most advantageously 7-13 g/l. The slurry is mixed into the stock flow, either by a separate mixer or e.g. by pumping into the stock flow. The stock may have varying pH depending on the type of pulp used, being typically in the range of 4-10, preferably 4.5-9.5.

Next the stock is treated with one or more retention chemicals, at least one of which is a cationic retention agent. Typical cationic retention agents comprise aluminium compounds like aluminium sulphate and polyaluminium chloride, cationic starch, cationic short-chained polyelectrolytes such as polydiallyl dimethyl ammonium chloride (polyDADMAC) and long-chained polyelectrolytes such as cationically charged polyacrylamides. The cationic retention agent is preferably a cationic polymer, such as cationic starch, or a copolymer of acrylamide and cationic comonomer, e.g. a copolymer formed of acrylamide and acryloyloxyethyltrimethyl ammonium chloride, having preferably a molecular weight above 500,000 g/mol. Anionic polyacrylamides can also be used as auxiliary retention agents in connection with a cationic retention agent.

When the stock is treated with a cationic retention agent, the amount of cationic retention agent is in the range of 25-10,000 g/t, preferably in the range of 50-1,000 g/t of dry matter of said stock. The stock treated with retention agents is fed through the headbox onto the wire, where the stock is filtered to form a web and further dried to form paper.

The stock can also be treated with an anionic colloid to enhance retention. This results in a process, in which the filler is first pre-treated with an inorganic colloid and then, either before or after the addition of cationic retention agent, the stock is treated with an anionic colloid. The latter anionic colloid may be either the same as the inorganic colloid used for filler pre-treatment, or a different one. Most advantageously, it is added after filtration of the stock, just before the headbox.

Finally the stock treated with retention chemicals is filtered to form a web on the wire. A steel wire preferably has an aperture size of 100-300 mesh, so that water is removed from the stock and the solid matter is retained on the wire, forming the paper web. Finally the web is dried to form paper.

The process of the invention may use other paper-improving agents, such as other retention chemicals and sizes such as resin, various hydrocarbon waxes and natural waxes, starch or its derivatives, casein, asphalt emulsions, synthetic resins and cellulose derivatives, colorants like water-soluble synthetic organic dies, water-dispersible pigments like carbon black, vat dye, pulp colour and sulphur dye; agents enhancing bounds between fibres such as: starch, natural rubbers, modified cellulose derivatives, urea and melamine formaldehyde condensates, etc.

In the paper manufacturing process, coated rejects are often added to the stock. In one embodiment, such coated rejects are preferably treated with an inorganic colloid before being added to an aqueous suspension of cellulose.

The method of the invention is most advantageously a paper manufacturing process in which titanium dioxide is pre-treated and suspended to form an aqueous slurry, the aqueous slurry obtained is combined with an aqueous slurry of cellulose to form a stock, the obtained stock is treated at least with a cationic retention agent and the treated stock is filtered to form paper, in which a filler is pre-treated with a colloidal metal silicate pertaining to synthetic silicates, in which the predominant metal is magnesium and having an average particle diameter in the range of 1-25 nm. It has been confirmed by experiments that the combination titanium dioxide-synthetic magnesium silicate yields excellent retention and also excellent optical properties.

Finally the invention relates to the use of an inorganic colloid having a diameter in the range of 1-100 nm for filler pre-treatment in paper production before the filler is added to the aqueous suspension of cellulose. This use involves the same special features and preferred embodiments as set forth above in connection with the description of the paper production method of the invention.

EXAMPLES

General Principle of Conducting DDJ Tests:

The stock used was composed of fibre samples from a paper mill, a filler and diluting water. The diluting water consisted principally of a clarified filtrate from the papermaking machine. The pH of the stock was regulated to the desired level.

The filler was treated in the form of a slurry with the desired amount of active ingredient to be examined before the filler was added to the stock. The doses are indicated as amounts of active ingredient of the dosed substance per dry matter weight of the filler, in units g/t (filler). The substance to be examined was added to the filler in the form of a diluted aqueous slurry.

Retention tests were conducted with a Dynamic Drainage Jar (DDJ) apparatus. The tests used the following step-wise procedure:

1. At moment 0 s and at a stirring rate of 1500 rpm a stock sample (500 ml) was poured into a vessel.
2. At moment 10 s polymer was dosed into the stock.
3. At moment 45 s a filtrate sample was collected, 100 ml.

The wire was a DDJ wire 125P with 200 mesh apertures. The polymer was a cationic polyacrylamide from Kemira Chemicals, which is a copolymer of acrylamide and acryloyloxyethyltrimethyl ammonium chloride, and whose charge is approx. 1 meq/g and molecular weight 7 mg/mol (PAM1). The polymer doses are indicated as substance doses per dry matter weight of the stock, in units g/t.

The overall consistency of the pulps and filtered liquors was produced by filtering the solid matter separately and drying it in a heating chamber at a temperature of 100-105° C. The filler consistency of the stocks and the filtered liquors were obtained by burning the samples dried in a heating chamber at 525° C. for 3 hours.

Example 1

Example 1 illustrates how a synthetic colloidal metal silicate, Laponite RD, acts with different fillers.

The tests were conducted as DDJ tests. The stock fibres consisted of bleached tall and birch pulps, which were used in the dry weight ratio 1:2. The fillers comprised

- Precipitated calcium carbonate, PCC, taken in the form of a slurry from the same mill as the chemical pulps,
- Pulverised calcium carbonate, GCC, under the trade name Mikhart 2, manufacturer Provencale S.A. and
- Titanium dioxide, $TiO_2$, under the trade name Kemira RDDI, manufacturer Kemira Chemicals Oy. $TiO_2$ was used as a mixture with GCC in the weight ratio GCC: $TiO_2$=80:20.

A clear filtrate from a fine paper machine up to a consistency of 10 g/l was used for diluting the stocks, followed by final dilution with ion-exchanged water to the test consistency.

The filler was treated with various amounts of the substance to be examined, which in this examples was a synthetic, colloidal metal silicate with magnesium as the predominant cation, sold under the trade name Laponite RD, manufacturer Laporte (nowadays Rockwood). Laponite RD has a particle size of approx. 25 nm and a specific area (BET) of approx. 400 $m^2/g$.

A separate stock was prepared for each Laponite RD dosing level. The polymer (PAMI) dosage was 400 g/t. Laponite RD was added to the filler in the form of a 0.5% slurry. The tests are averages of two parallel tests.

The results of the tests with different fillers are collected in table 1.

TABLE 1

Filler and overall retention results of fine paper pulp with the filler treated before it was added to the stock with various amounts of Laponite RD.

| Filler | Laponite RD g/t (filler) | Overall consistency of stock g/l | Filler consistency of stock g/l | Stock pH | Filler retention, % | Total retention, % |
|---|---|---|---|---|---|---|
| PCC | 0 (reference) | 8.4 | 3.4 | 8.0 | 11.9 | 60.5 |
| PCC | 500 | 8.4 | 3.3 | 8.0 | 13.3 | 61.6 |
| PCC | 1000 | 8.3 | 3.4 | 8.1 | 15.9 | 63.1 |
| PCC | 3000 | 8.4 | 3.3 | 8.0 | 16.6 | 63.4 |
| GCC | 0 (reference) | 8.3 | 3.4 | 8.0 | 15.7 | 62.9 |
| GCC | 500 | 8.5 | 3.4 | 8.0 | 19.4 | 64.2 |
| GCC | 1000 | 8.5 | 3.3 | 8.0 | 20.0 | 64.3 |
| GCC | 3000 | 8.6 | 3.4 | 8.0 | 20.6 | 64.3 |
| GCC | 5000 | 8.4 | 3.3 | 8.1 | 20.5 | 64.5 |
| GCC/$TiO_2$ 80/20 | 0 (reference) | 9.2 | 4.3 | 8.0 | | 54.1 |
| GCC/$TiO_2$ 80/20 | 500 | 9.6 | 4.3 | 8.0 | | 58.5 |
| GCC/$TiO_2$ 80/20 | 1000 | 9.6 | 4.2 | 8.1 | | 61.4 |
| GCC/$TiO_2$ 80/20 | 3000 | 9.7 | 4.2 | 8.1 | | 63.2 |

This example clearly shows that both the filler retention and the overall retention are clearly improved with Laponite RD dosed along with the filler. In addition, as a rule, the greater the Laponite RD dose, the better retention.

Example 2

Example 2 illustrates the activity of synthetic colloidal metal silicate, Laponite RD, with mechanical pulp included in the stock.

The tests were conducted as DDJ tests. Two different types of stock were used:

The higher pH stock contained peroxide-bleached thermomechanical pulp (TMP) and bleached tall pulp. The pulps were used in the dry weight ratio 4:1.

For stock dilution, a clear filtrate was taken from a neutrally (pH of about 7.5) running paper-making machine using mechanical pulp, by means of which the stock was diluted up to a consistency of 10 g/l, followed by final dilution with ion-exchanged water to the test consistency.

The lower pH stock contained dithionite-bleached thermomechanical pulp (TMP) and bleached tall pulp. These pulps were used in a dry matter ratio 4:1. For stock dilution, a clear filtrate was taken from an acidly (pH of about 5) running paper-making machine using mechanical pulp, by means of which the stock was diluted up to a consistency of 10 g/l, followed by final dilution with ion-exchanged water to the test consistency.

Both in the high and the low pH stock kaolin was used as a filler, which is sold under the trade name Intramax. It was treated with various amounts of substance to be examined, which, in this example, was a synthetic colloidal metal silicate having magnesium as the predominant cation, which is sold under the trade name Laponite RD, manufacturer Laporte (nowadays Rockwood).

A separate stock was prepared for each Laponite RD dosage level. The polymer (PAM1) dose was 400 g/t. Laponite RD was added to the filler in the form of a 0.5% slurry. The tests are mean values of two parallel tests.

The test results with different fillers are collected in table 2.

TABLE 2

Filler and overall retention results of stocks containing mechanical pulp at two pH values, with the filler treated with different amounts of Laponite RD before being added to the stock.

| Laponite RD g/t (filler) | Overall consistency of stock, g/l | Filler consistency of stock, g/l | Stock, pH | Filler retention, % | Overall retention, % |
|---|---|---|---|---|---|
| 0 (reference) | 7.9 | 3.0 | 7.6 | 16.4 | 55.3 |
| 500 | 7.9 | 3.0 | 7.6 | 17.6 | 57.2 |
| 1000 | 8.0 | 3.0 | 7.6 | 17.7 | 57.4 |
| 0 (reference) | 7.9 | 3.2 | 5.1 | 14.5 | 51.5 |
| 500 | 8.0 | 3.2 | 5.0 | 15.5 | 51.8 |
| 1000 | 8.0 | 3.2 | 5.0 | 14.9 | 52.1 |

This example clearly shows that both the filler retention and the overall retention improved, although less distinctly than with fine paper pulp, with Laponite RD dosed along with the filler. In addition, as a rule, the higher the Laponite RD dose, the better retention.

Example 3

Example 3 illustrates that colloidal silicas and silica particles of other types also act as a retention improving agent when the filler is treated with these before being added to the stock.

The tests were conducted as DDJ tests. The stock fibres consisted of bleached tall and birch pulps, which were used in the dry matter ratio 1:2. The filler consisted of pulverised calcium carbonate, GCC, sold under the trade name Mikhart 2, manufacturer Provencale S.A.

The stocks were diluted with a clear filtrate up to a consistency of 10 g/l from a fine paper machine, followed by final dilution with ion-exchanged water to the test consistency. The clear filtrate used originated from the same papermaking machine as the one in example 1, but taken at a different moment, so that the stocks had pH about 8.

The filler was treated with different amounts of substance to be examined, which in this example were bentonite, the main component of which is montmorillonite, sold under the trade name Altonit SF, supplier Kemira Chemicals Oy, was added to the filler in the form of a 0.2% slurry. Altonit SF in dry state has a specific area (BET) of approx. 30 $m^2/g$ and of approx. 400 $m^2/g$ in wet state, fumed silica, with the trade name Aerosil MOX 170, manufacturer Degussa, was added to the filler in the form of a 0.2% slurry. Aerosil MOX 170 has a particle size of approx. 15 nm and a specific area (BET) of approx. 170 $m^2/g$, structurised silica sol, with the trade name BMA 780, producer Akzo Nobel, was added to the filler as a 3% sol diluted to an active ingredient content of 8%. The particle size of BMA 780 is not exactly known, however, it is supposed to be less than 10 nm, unstructurised silica sol, under the trade name Vinsil 515, producer Kemira Chemicals, Inc., was added to the filler as a 3% sol diluted to an active ingredient content of 15%. Vinsil 515 has a particle size of approx. 5 nm and a specific area of about 600 $m^2/g$.

A separate stock was prepared for each dosing level. The polymer (PAM1) dosage was 400 g/t. The tests are mean values of two parallel tests.

The test results are collected in table 3.

TABLE 3

Filler and overall retention results of fine paper pulp with the filler treated before it was added to the stock with various amounts of different types of colloidal silica or silicate-based particles

| Substance added to filler | Dosage of substance added to filler, g/t (filler), as the active ingredient | Overall stock consistency g/l | Stock filler consistency, g/l | Filler retention, % | Overall retention, % |
|---|---|---|---|---|---|
| Altonit SF | 0 (reference) | 8.1 | 3.7 | 3.1 | 52.8 |
| Altonit SF | 1000 | 8.0 | 3.5 | 14.6 | 58.8 |
| Altonit SF | 3000 | 8.1 | 3.6 | 16.8 | 60.4 |
| Altonit SF | 5000 | 8.2 | 3.6 | 17.2 | 60.8 |
| Altonit SF | 10000 | 8.2 | 3.6 | 17.6 | 60.4 |
| Aerosil MOX 170 | 0 (reference) | 8.1 | 3.7 | 3.1 | 52.8 |
| Aerosil MOX 170 | 1000 | 7.5 | 3.5 | 10.1 | 54.7 |
| Aerosil MOX 170 | 3000 | 8.0 | 3.6 | 15.1 | 58.9 |
| Aerosil MOX 170 | 5000 | 8.1 | 3.5 | 16.4 | 60.3 |
| Aerosil MOX 170 | 10000 | 7.9 | 3.5 | 16.9 | 59.2 |
| BMA 780 | 0 (reference) | 8.2 | 3.4 | 5.4 | 57.4 |
| BMA 780 | 500 | 8.0 | 3.5 | 12.6 | 58.4 |
| BMA 780 | 1000 | 7.8 | 3.6 | 15.5 | 58.3 |
| BMA 780 | 3000 | 7.9 | 3.6 | 16.8 | 59.5 |
| BMA 780 | 5000 | 8.0 | 3.6 | 17.7 | 60.7 |
| Vinsil 515 | 0 (reference) | 8.2 | 3.4 | 5.4 | 57.4 |
| Vinsil 515 | 500 | 7.8 | 3.4 | 10.0 | 56.7 |
| Vinsil 515 | 1000 | 7.8 | 3.5 | 11.4 | 57.9 |
| Vinsil 515 | 3000 | 8.0 | 3.5 | 17.3 | 61.3 |
| Vinsil 515 | 5000 | 8.2 | 3.6 | 17.6 | 60.0 |

This example clearly shows that both the filler retention and the overall retention improved with different colloidal silica or silicate-based particles dosed along with the filler. In addition, as a rule, the higher the particle dose, the better the retention.

Example 4

Example 4 illustrates how various types of colloidal silica and silicate particles act as retention improving agents when the filler is treated with them before being added to the stock, even when the stock contains mechanical pulp.

The tests were conducted as DDJ tests.

The pulps consisted of peroxide-bleached thermomechanical pulp (TMP) and bleached tall pulp. These pulps were used in a dry weight ratio of 4:1. The filler was kaolin, sold under the trade name Intramax. For stock dilution, a clear filtrate was taken from a neutrally (pH of about 7.5) running papermaking machine using mechanical pulp, by means of which the stock was diluted up to a consistency of 10 g/l, followed by final dilution with ion-exchanged water to the test consistency.

The filler was treated with various amounts of the substance to be examined, which were the same in this example as those described in example 3.

A separate stock was prepared for each dosing level. The stock had pH 7.5. The polymer (PAM1) dosage was 400 g/t. The tests are mean values of two parallel tests.

The test results are collected in table 4.

TABLE 4

Filler and overall retention results of stocks containing mechanical pulp with the filler treated before it was added to the stock with various amounts of different types of colloidal silicate-based particles

| Substance added to filler | Dosage of substance added to filler, g/t (filler), as an active ingredient | Overall stock consistency g/l | Stock filler consistency, g/l | Filler retention, % | Overall retention, % |
|---|---|---|---|---|---|
| Altonit SF | 0 (reference) | 8.0 | 2.5 | 19.4 | 58.0 |
| Altonit SF | 500 | 8.1 | 2.5 | 21.9 | 60.1 |
| Aerosil MOX 170 | 0 (reference) | 8.0 | 2.5 | 19.4 | 58.0 |
| Aerosil MOX 170 | 1000 | 7.9 | 2.5 | 21.3 | 60.2 |
| Aerosil MOX 170 | 3000 | 7.9 | 2.5 | 21.7 | 60.6 |
| BMA 780 | 0 (reference) | 8.0 | 2.6 | 22.0 | 60.9 |
| BMA 780 | 500 | 8.1 | 2.6 | 24.9 | 62.1 |
| BMA 780 | 1000 | 8.1 | 2.6 | 26.0 | 62.2 |
| Vinsil 515 | 0 (reference) | 8.0 | 2.6 | 22.0 | |
| Vinsil 515 | 1000 | 8.2 | 2.5 | 22.8 | |
| Vinsil 515 | 3000 | 8.3 | 2.6 | 23.3 | |

This example clearly shows that both the filler retention and the overall retention improved with different colloidal silica or silicate-based particles dosed along with the filler, even when the stock contained mechanical pulp. In addition, as a rule, the higher the particle dose, the better the retention.

Example 5

The example describes how Laponite RD metal silicate has retention improving action when the tests are conducted with a different test arrangement. In this arrangement, the second portion of a filler treated with colloidal silica and silicate particles is added to the stock containing the first portion of the filler.

The retention tests were conducted with a Moving Belt Former simulator. The stock consisted of stock fed to the headbox of a papermaking machine using mechanical pulp. The stock sample was taken just before the retention agent additions. The main components of the stock to be treated were thermomechanical pulp (TMP), tall pulp and fillers, of which kaolin formed the major portion. The stock consistency before additions was 12 g/l and the stock had a dry matter filler content of 56%.

Four different stocks were prepared. Four different titanium dioxide slurries were added to the stocks, increasing the stock consistency to 13.2 g/l. Two of the titanium dioxide slurries had been treated with Laponite RD in a dose of 4 kg/t (filler) and two had not been treated at all. The titanium dioxides were Kemira 920, producer Kemira Chemicals Oy, and Kemira RDE2, producer Kemira Chemicals Oy. These stocks were used in an amount of 333 g per test. The stocks had a pH value of approx. 5. The stocks are described in greater detail in table 5.

The vacuum level aimed at by passing air though a sheet was −25 kPa. The effective absorption period was 250 ms. The stock temperature during the tests was 50° C. The stirring rate was 2000 rpm. The polymers were dosed 10 s before filtering of the web. The conditioned basis weight of the sheets was measured and used for calculating the overall retention.

The test used as polymers PAM1 and PAM2, which is a cationic polyacrylamide having a charge of about 2 meq/g and a molecular weight of about 5 Mg/mol, manufacturer Kemira Chemicals Oy.

The results are given in table 5.

TABLE 5

Improving effect of Laponite RD on titanium dioxide retention

| Test no | $TiO_2$ quality | Laponite RD dosage, g/t (filler) | Polymer | Polymer dosage, g/t | Basis weight of sheet g/m$^2$ | Overall retention, % | $TiO_2$ proportion of paper ash, % |
|---|---|---|---|---|---|---|---|
| 1 | Kemira 920 | 0 | PAM2 | 400 | 70.9 | 58.1 | 13.4 |
| 2 | Kemira 920 | 4000 | PAM2 | 400 | 77.8 | 63.7 | 15.6 |
| 3 | Kemira 920 | 0 | PAM1 | 200 | 59.7 | 48.9 | |
| 4 | Kemira 920 | 4000 | PAM1 | 200 | 66.5 | 54.5 | |
| 5 | Kemira 920 | 0 | PAM1 | 400 | 71.3 | 58.4 | |
| 6 | Kemira 920 | 4000 | PAM1 | 400 | 80.9 | 66.3 | |
| 7 | Kemira 920 | 0 | no polymer | no polymer | 36.0 | 29.5 | 3.9 |
| 8 | Kemira 920 | 4000 | no polymer | no polymer | 40.3 | 33.0 | 8.2 |
| 9 | Kemira RDE2 | 0 | PAM2 | 400 | 75.0 | 61.4 | 14.3 |
| 10 | Kemira RDE2 | 4000 | PAM2 | 400 | 76.9 | 63.0 | 15.0 |
| 11 | Kemira RDE2 | 0 | PAM1 | 200 | 62.0 | 50.7 | |

TABLE 5-continued

Improving effect of Laponite RD on titanium dioxide retention

| Test no | $TiO_2$ quality | Laponite RD dosage, g/t (filler) | Polymer | Polymer dosage, g/t | Basis weight of sheet g/m$^2$ | Overall retention, % | $TiO_2$ proportion of paper ash, % |
|---|---|---|---|---|---|---|---|
| 12 | Kemira RDE2 | 4000 | PAM1 | 200 | 64.4 | 52.7 | |
| 13 | Kemira RDE2 | 0 | PAM1 | 400 | 75.1 | 61.5 | |
| 14 | Kemira RDE2 | 4000 | PAM1 | 400 | 79.0 | 64.7 | |
| 15 | Kemira RDE2 | 0 | no polymer | no Polymer | 40.2 | 33.0 | 6.7 |
| 16 | Kemira RDE2 | 4000 | no polymer | no polymer | 41.1 | 33.6 | 8.5 |

The tests show that each time titanium dioxide has contained Laponite RD, the sheet has formed with a higher basis weight, although the stock dose has remained the same in all of the tests. This is due to the fact that Laponite RD has enhanced the retention of the fillers, also of those previously contained in the stock. It is remarkable that Laponite RD has enhanced the retention also in cases where no retention polymer has been used (comparative tests 7 and 8 and 15 and 16, respectively).

A comparison of tests 4-6 of the example allows the evaluation that a retention level of 58.4%, which is achieved with a PAM1 dosage of 400 g/t when Kemira 920 has not been treated with Laponite RD, is achieved with a PAM1 dosage of about 270 g/t, when Kemira 920 has been treated with Laponite RD. Accordingly, a comparison of tests 12-14 allows the evaluation that the same retention level of 61.5%, which is achieved with a PAM1 dosage of 400 g/t when Kemira RDE2 has not been treated with Laponite RD, is achieved with a PAM1 dosage of about 350 g/t when Kemira RDE2 has been treated with Laponite RD.

Sheets in which the titanium dioxide content of ash was determined after ashing by an X-ray fluorescence method showed a higher titanium dioxide content in the ash each time the titanium dioxide had contained Laponite RD. This also indicates the improving effect of Laponite RD on titanium dioxide retention.

Example 6

The example describes how Laponite RD metal silicate has an improving effect on both retention and optical efficiency.

The tests were conducted with a Moving Belt Former simulator using the running parameters described in example 5. However, in this case, the stock was composed of machine tank pulp taken from a papermaking machine using mechanical pulp and having a filler content of approx. 25% and of a clear filtrate from the same papermaking machine. Fillers used by the same paper-making machine were added to the pulp, with the main portion being kaolin, and titanium dioxide, Kemira 920, and calcinated kaolin taken from the same paper-making machine, the final filler content of the stock dry matter being approx. 55%, about 7.5% units of which was calcinated kaolin and about 7.5% unit was titanium dioxide.

Titanium dioxide and calcinated kaolin were mixed together as slurries 30 min before they were added to the stock. Two stocks were prepared, with one containing titanium dioxide, to which 4 kg/t (filler) of Laponite RD had been added, and with no Laponite RD addition at all to the other one.

After the filler addition, the stock consistency was 13.2 g/l, which was diluted to operation consistency of about 10 g/l using tap water. The stocks had a pH value of about 6. The polymer was PAM2.

The results are given in table 6.

TABLE 6

Improving effect of Laponite RD on titanium dioxide retention and optical efficiency

| Laponite RD together with $TiO_2$ | Polymer dosage, g/t | Basis weight of conditioned sheet, g/m$^2$ | Sheet ISO brightness measured on top side, % | Sheet ISO brightness measured on wire side, % |
|---|---|---|---|---|
| no | 180 | 57.2 | 77.0 | 75.2 |
| no | 225 | 59.7 | 78.2 | 76.0 |
| no | 270 | 61.9 | 78.6 | 76.2 |
| no | 315 | 62.7 | 78.7 | 76.7 |
| no | 349 | 65.2 | 79.1 | 76.9 |
| yes | 124 | 56.7 | 78.1 | 76.3 |
| yes | 163 | 60.0 | 79.0 | 76.8 |
| yes | 203 | 62.7 | 79.3 | 77.2 |
| yes | 242 | 64.0 | 79.5 | 77.8 |
| yes | 282 | 66.7 | 80.1 | 78.2 |

Primarily, the results still show that the same polymer dosage yields a heavier sheet when the titanium dioxide had been treated with Laponite RD. This is due to the improving effect of Laponite RD on filler retention. Examination of the sheets further shows that the same basis weight level yields higher sheet brightness when the titanium dioxide had been treated with Laponite RD. This is due to higher titanium dioxide retention to the sheet under the effect of Laponite RD.

Example 7

Example 7 describes how a synthetic colloidal metal silicate, Laponite RD, has an improving action on filler retention even when no retention agent is used at all.

The tests were conducted as DDJ tests according to the general principle, however, without using any retention polymer at all. The stock fibres were bleached tall and birch pulp, which were used in the dry weight ratio 1:2. The fillers were pulverised calcium carbonate, GCC, with the trade name Mikhart 2, producer Provencale S.A. For stock dilution, a clear filtrate was taken from a fine paper machine up to a consistency of 10 g/l, followed by final dilution with ion-exchanged water to the test consistency.-

The tests were conducted with two stocks that were otherwise identical, except that the filler of one stock was pretreated with the examined substance before the filler was added to the stock. The filler was treated with synthetic colloidal metal silicate, with magnesium as the predominant cation, sold under the trade name Laponite RD, producer Laporte (nowadays Rockwood). Laponite RD has a particle size of about 25 nm and a specific area (BET) of about 400 $m^2/g$. Laponite RD was used in an amount of 3 kg/t (filler).

The test results with different fillers are collected in table 7. The test results are mean values of two parallel tests.

TABLE 7

Results of filler and overall retention in fine paper pulp with the filler treated with Laponite RD before it was added to the stock.

| Laponite RD g/t (filler) | Overall consistency of stock, g/l | Filler consistency of stock, g/l | Stock pH | Filler retention, % | Overall retention, % |
|---|---|---|---|---|---|
| 0 (reference) | 7.9 | 3.1 | 8.0 | 4.4 | 57.2 |
| 3000 | 7.9 | 3.2 | 8.0 | 16.1 | 43.9 |

This example clearly indicates that both filler retention and overall retention were distinctly improved with Laponite RD dosed along with the filler, although the tests did not use any retention polymer at all.

Example 8

Example 8 is a comparison between the use of microparticles in accordance with the invention and in accordance with prior art.

The tests were conducted as DDJ tests according to the general principle, however, with the following dosage used as the dosage sequence:

1. At moment 0 s with a stirring rate of 1,500 rpm a stock sample (500 ml) was poured into a vessel.
2. At moment 10 s a chemical ANN1 was dosed into the stock.
3. At moment 35 s a chemical ANN2 was dosed into the stock.
4. At moment 45 s a filtrate sample of 100 ml was collected.

In the prior art procedure, the microparticle was added to the stock at dose position ANN2 as a 0.4% slurry.

The stock fibres consisted of bleached tall and birch pulp, which were used in the dry weight ratio 1:2. The fillers were pulverised calcium carbonate, GCC, with the trade name Mikhart 2, producer Provencale S.A.

For stock dilution, a clear filtrate was taken from a fine paper machine up to a consistency of 10 g/l, followed by final dilution with ion-exchanged water to the test consistency.

The tests were conducted with two stocks that were otherwise identical, except that the filler of one stock was pretreated with the examined substance before the filler was added to the stock. The filler was treated with synthetic colloidal metal silicate, with magnesium as the predominant cation, sold under the trade name Laponite RD, producer Laporte (nowadays Rockwood). Laponite RD has a particle size of about 25 nm and a specific area (BET) of about 400 $m^2/g$. Laponite RD was used in an amount of 3 kg/t (filler).

The test results with two ways of using microparticles are collected in table 8. The test results are mean values of two parallel tests.

TABLE 8

Results of filler retention and overall retention in fine paper pulp, with the microparticle used in accordance with the invention and in accordance with prior art

| Laponite RD g/t (filler) | Chemical ANN1 | ANN1 dosage, g/t of dry stock | Chemical ANN2 | ANN2 dosage, g/t of dry stock | Overall consistency of stock, g/l | Filler consistency of stock, g/l | Stock pH | Filler retention, % | Overall retention, % |
|---|---|---|---|---|---|---|---|---|---|
| 0 (prior art) | PAM1 | 200 | Laponite RD | 1200*) | 7.9 | 3.1 | 8.0 | 4.7 | 58.0 |
| 0 | PAM1 | 300 | Laponite RD | 1200 | 7.9 | 3.1 | 8.0 | 16.1 | 61.9 |
| 0 | PAM1 | 400 | Laponite RD | 1200 | 7.9 | 3.1 | 8.0 | 21.3 | 67.2 |
| 3000 (invention) | — | — | PAM1 | 200 | 7.9 | 3.2 | 8.0 | 18.2 | 64.1 |
| 3000 | — | — | PAM1 | 300 | 7.9 | 3.2 | 8.0 | 19.8 | 66.9 |
| 3000 | — | — | PAM1 | 400 | 7.9 | 3.2 | 8.0 | 26.6 | 67.5 |

*)corresponding to the dose 3,000 g/t (of filler) dosed directly into the filler with the ratio filler/fibre used in the tests When the results of tests with the same amounts of retention polymer are mutually compared, this example clearly shows that the use of the microparticle Laponite RD in accordance with the invention is more advantageous than the prior art procedure.

Example 9

Example 9 is a comparison between the use of microparticles in accordance with the invention and in accordance with prior art. The example used a different microparticle from that of example 8.

The tests were conducted as DDJ tests as in example 8, however, the microparticle in the prior art procedure was bentonite, whose major component is montmorilloinite, with the trade name Altonit SF, supplier Kemira Chemicals Oy. Altonit SF in dry state has a specific area (BET) of about 30 $m^2/g$, and of about 400 $m^2/g$ in wet state.

In the prior art procedure, the microparticle was added to the stock at the dose location ANN2 as a 0.5% slurry.

The test results are collected in table 9. The test results are mean values of two parallel tests.

TABLE 9

Results of filler retention and overall retention in fine paper pulp, with the microparticle used in accordance with the invention and in accordance with prior art

| Laponite RD g/t (filler) | Chemical ANN1 | ANN1 dosage, g/t of dry stock | Chemical ANN2 | ANN2 dosage, g/t of dry stock | Overall consistency of stock, g/l | Filler consistency of stock, g/l | Stock pH | Filler retention, % | Overall retention, % |
|---|---|---|---|---|---|---|---|---|---|
| 0 (prior art) | PAM1 | 200 | Altonit SF | 1000 | 7.9 | 3.1 | 8.0 | 10.1 | 59.6 |
| 0 | PAM1 | 300 | Altonit SF | 1000 | 7.9 | 3.1 | 8.0 | 17.0 | 63.5 |
| 3000 (invention) | — | — | PAM1 | 200 | 7.9 | 3.2 | 8.0 | 18.2 | 64.1 |
| 3000 | — | — | PAM1 | 300 | 7.9 | 3.2 | 8.0 | 19.8 | 66.9 |

This example also clearly shows that the use of microparticles in accordance with the invention is the more advantageous of the two procedures.

The invention claimed is:

1. A process for the manufacturing of paper, said process comprising the steps of:

pre-treating a portion of a filler amount intended for a stock with anionic colloidal particles having an average particle size in water of less than 100 nm and having a specific area (BET) in the range of 30-1,000 $m^2/g$ by combining an aqueous slurry or a sol of said inorganic colloidal particles and a filler slurry having a concentration of 20-50%, wherein the weight proportion of inorganic colloidal particles in the total weight of said particles and the pre-treated portion of filler amount is in the range of 0.5-20 kg/t and wherein a stock formed by the combination has a total consistency in the range of 3-20 g/l, combining the aqueous slurry of pre-treated filler with an aqueous suspension containing cellulose fibers to form the stock, comprising the steps of:

treating the formed stock at least with a cationic retention agent which is a cationic polyacrylamide or acrylamide copolymer having a molecular weight of at least 500,000 g/mol, and filtering the treated stock to form a web and drying the web to form said paper.

2. A process as defined in claim 1, wherein the filler is treated with inorganic colloidal particles so that the surface of the filler particles will at least partly consist of inorganic colloidal particles.

3. A process as defined in claim 2, wherein the anionic colloidal particles consist of synthetic silicate and/or hectorite.

4. A process as defined in claim 2, wherein the anionic colloidal particles consist of smectite or montmorillonite-based (bentonite) silicate.

5. A process as defined in claim 2, wherein the anionic colloidal particles consist of colloidal silica sol and/or polysilicic acid.

6. A process as defined in claim 2, wherein the anionic colloidal particles consist of colloidal metal silicate pertaining to synthetic silicates and having magnesium as the predominant cation.

7. A process as defined in claim 1, wherein, the inorganic colloidal particles have an average particle diameter in the range of 1-80 nm.

8. A process as defined in claim 1, wherein the filler is pre-treated with inorganic colloidal particles in an amount varying in the range of 50-10,000 g/t, calculated on the total amount of dry filler.

9. A process as defined in claim 1, wherein the entire filler amount intended for the stock is pre-treated with inorganic colloidal particles.

10. A process as defined in claim 1, wherein the filler is treated by combining a slurry or a sol of inorganic colloidal particles and a filler slurry.

11. A process as defined in claim 10, wherein the slurry or sol of inorganic colloidal particles has a concentration of 0.5-30%.

12. A process as defined in claim 10, wherein the slurry or sol of inorganic colloidal particles has a concentration of 1-10%.

13. A process as defined in claim 1, wherein the filler is an inorganic particulate substance.

14. A process as defined in claim 13, wherein the inorganic particulate substances are selected from the group consisting of kaolin, calcinated kaolin, calcium carbonate, talcum, titanium dioxide, calcium sulphate, synthetic silicate and aluminum hydroxide fillers and mixtures thereof.

15. A process as defined in claim 14, wherein the inorganic particulate substance is titanium dioxide.

16. A process as defined in claim 15, wherein the titanium dioxide has an average particle diameter in the range of 150-350 nm.

17. A process as defined in claim 15, wherein the titanium dioxide has an average particle diameter in the range of 200 nm.

18. A method as defined in claim 1, wherein the total amount of filler accounts for 10-60%, of the total amount of the dry weight of the stock.

19. A method as defined in claim 1, wherein the aqueous filler slurry has a concentration of 5-70%.

20. A method as defined in claim 1, wherein the cellulose of the aqueous suspension of cellulose originates from chemical, mechanical or chemo-mechanical pulp, recycled fibers or a mixture thereof.

21. A method as defined in claim 1, wherein the aqueous suspension of cellulose has a consistency in the range of 1-50 g/l.

22. A method as defined in claim 1, wherein the copolymer of acrylamide and the cationic comonomer is a copolymer of acrylamide and acryloyloxyethyltrimethyl ammonium chloride having a molecular weight above 500,000 g/mol.

23. A method as defined in claim 1, wherein the amount of cationic polymer is in the range of 25-10,000 g/t of dry matter of said stock.

24. A method as defined in claim 1, wherein the stock is treated with anionic colloidal particles, which may be different from said inorganic colloidal particles used for filler pre-treatment.

25. A method as defined in claim 1, wherein the stock is filtered through a steel wire having 100-300 mesh apertures to form paper.

26. A method as defined in claim 1, including the use of other paper-improving agents, and other retention chemicals, size, dies and fiber binders.

27. A process as defined in claim 1, wherein, the inorganic colloidal particles have an average particle diameter in the range of 1-50 nm.

28. A process as defined in claim 1, wherein, the inorganic colloidal particles have an average particle diameter in the range of 1-25 nm.

29. A process as defined in claim 1, wherein the powder formed of inorganic colloidal particles has a specific area (BET) in the range of 100-1,000 $m^2/g$.

30. A process as defined in claim 1, wherein the filler is pre-treated with inorganic colloidal particles in an amount varying in the range of 500-5,000 g/t, calculated on the total amount of dry filler.

31. A process as defined in claim 1, wherein the weight proportion of inorganic colloidal particles in the total weight of these particles and the pre-treated portion of filler amount is in the range of 1-10 kg/t.

32. A method as defined in claim 1, wherein the total amount of filler accounts for 20-50%, of the total amount of the dry weight of the stock.

33. A method as defined in claim 1, wherein the aqueous suspension of cellulose has a consistency in the range of 5-15 g/l.

34. A method as defined in claim 1, wherein the aqueous slurry is combined with an aqueous suspension of cellulose to form a stock having a total consistency in the range of 7-13 g/l.

35. A method as defined in claim 1, wherein the amount of cationic polymer is in the range of 50-1,000 g/t of dry matter of said stock.

36. A method as defined in claim 1, wherein the stock is treated with anionic colloidal particles, which may be identical to said inorganic colloidal particles used for filler pre-treatment.

* * * * *